US008262376B2

(12) United States Patent
Inoue

(10) Patent No.: US 8,262,376 B2
(45) Date of Patent: Sep. 11, 2012

(54) HIGH-PRESSURE PUMP

(75) Inventor: Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 183 days.

(21) Appl. No.: 12/906,291

(22) Filed: Oct. 18, 2010

(65) Prior Publication Data

US 2011/0110808 A1 May 12, 2011

(30) Foreign Application Priority Data

Nov. 9, 2009 (JP) ..... 2009-256384

(51) Int. Cl.
*F04B 11/00* (2006.01)

(52) U.S. Cl. ..... 417/540

(58) Field of Classification Search ..... 138/30; 417/415, 471, 540

See application file for complete search history.

(56) References Cited

U.S. PATENT DOCUMENTS

| | | | | |
|---|---|---|---|---|
| 7,124,738 | B2 * | 10/2006 | Usui et al. | 123/446 |
| 2008/0289713 | A1 * | 11/2008 | Munakata et al. | 138/26 |
| 2009/0185922 | A1 * | 7/2009 | Inoue et al. | 417/540 |

FOREIGN PATENT DOCUMENTS

| | | |
|---|---|---|
| JP | 2008-14319 | 1/2008 |
| JP | 2008-111396 | 5/2008 |
| JP | 2009-108783 | 5/2009 |

OTHER PUBLICATIONS

Japanese Office Action dated Sep. 26, 2011, issued in corresponding Japanese Application No. 2009-256384 with English Translation.

* cited by examiner

*Primary Examiner* — Devon Kramer
*Assistant Examiner* — Bryan Lettman
(74) *Attorney, Agent, or Firm* — Nixon & Vanderhye PC

(57) ABSTRACT

An extended passage of a press-side passage is supposed in a fuel gallery. This supposed extended passage of the press-side passage extends toward a lid member. The press-side passage is opened at the side wall of the fuel gallery. A center axis of the press-side passage is inclined in such a manner that a fuel returning from the press-side passage to the fuel gallery flows toward the lid member. A bottom-side fringe of a damper unit does not exist in the supposed extended passage.

5 Claims, 2 Drawing Sheets

HIGH-PRESSURE PUMP

CROSS-REFERENCE TO RELATED APPLICATION

This application is based on Japanese Patent Application No. 2009-256384 filed on Nov. 9, 2009, the disclosure of which is incorporated herein by reference.

FIELD OF THE INVENTION

The present invention relates to a high-pressure pump used for an internal combustion engine.

BACKGROUND OF THE INVENTION

The high-pressure pump is generally provided with a plunger which reciprocates along with a camshaft of an engine. Specifically, when the plunger slides down from its top dead center to its bottom dead center, a fuel in a fuel gallery is suctioned into a compression chamber (suction stroke). When the plunger slides up from the bottom dead center to the top dead center, a part of the low-pressure fuel is returned to the fuel gallery (metering stroke). Then, after a suction valve is closed, when the plunger further slides up, the fuel in the compression chamber is compressed (compression stroke).

As an engine speed becomes high and a rotational speed of a camshaft also becomes high, the plunger reciprocates at high speed. As a result, a variation in fuel pressure in a fuel gallery is made large to generate a pulsation.

Japanese Patent No. 4036153 (U.S. Pat. No. 7,124,738B2) shows a high-pressure pump having a pulsation damper in a fuel gallery to attenuate a pulsation of fuel. The pulsation damper is a diaphragm made of metallic material.

The diaphragm moves inward or outward in accordance with a differential pressure between a gas pressure applied to an inner surface of the diaphragm and the fuel pressure applied to an outer surface of the diaphragm. Thereby, the pulsation damper is deformed inward or outward to restrict the fuel pulsation. For example, in the metering stroke, when the fuel in the compression chamber is returned to the fuel gallery so that the fuel pressure in the fuel gallery increases, the pulsation damper is deformed inward to restrict an increase in fuel pressure.

In the high-pressure pump shown in Japanese Patent No. 4036153 (U.S. Pat. No. 7,124,738B2), since a fuel passage communicating to an upper space of the damper is restricted by a damper supporting member and a lid member, a large part of the fuel returning to a fuel gallery in a metering stroke flows in a lower space of the damper. Further, since a fuel inlet is formed at a lower space of the damper, when the fuel flow velocity is increased, it is likely that the fuel flows to the fuel inlet before the damper is deformed to restrict a fuel pressure increase. In such a case, the fuel pressure pulsation is transmitted to a fuel pipe and a fuel pipe supporting member, which may cause noise problems. If a resonance arises in the fuel pipe supporting member, the fuel pipe supporting member may be damaged.

SUMMARY OF THE INVENTION

The present invention is made in view of the above matters, and it is an object of the present invention to provide a high-pressure pump which is capable of restricting a fuel pressure pulsation even when a flow velocity of a fuel returning to a fuel gallery is increased.

According to the present invention, a high-pressure pump includes a press-side passage fluidly connecting a fuel gallery which has a fuel inlet at its bottom and a compression chamber in which the fuel is compressed. A plunger varies a volume of the compression chamber and defines a variable volume chamber of which volume is varied along with a variation in volume of the compression chamber. A volume-chamber passage fluidly connects the variable volume chamber and the fuel gallery. A damper unit is provided in the fuel gallery for restricting a variation in a fuel pressure in the fuel gallery. A lid member encloses the fuel gallery while biasing the damper unit through an elastic member. The press-side passage is configured in such a manner that a main stream of a fuel flow, which is returned from the compression chamber to the fuel gallery by the plunger, flows toward the lid member which opposes to the fuel inlet.

The mainstream of fuel when the flow velocity becomes high is led to the lid member of the damper unit. The fuel flows through the lid member, so that the fuel hardly flows into the fuel inlet 19 directly. Consequently, even when the flow velocity of the fuel returned to the fuel gallery is increased, the fuel pressure pulsation can be well restricted.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Hereafter, an embodiment of the present invention will be described. A high-pressure pump is mounted to a vehicle for pumping up fuel in a fuel tank through a fuel inlet and pressurizes the fuel. The high-pressure pump supplies the pressurized fuel to a fuel rail to which an injector is connected. The fuel inlet of the high-pressure pump is fluidly connected to a low-pressure pump (not shown) through a pipe.

Figure 1:
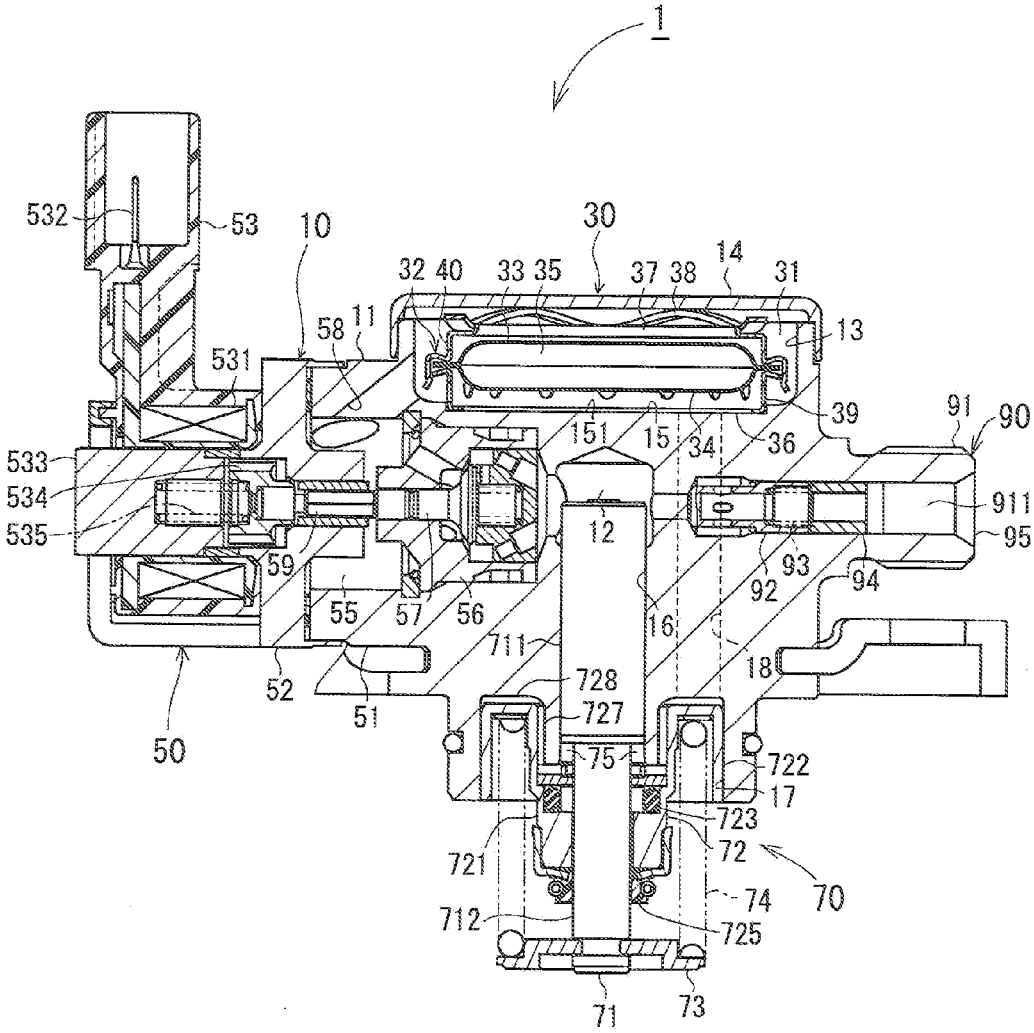
FIG. 1 is a cross-sectional view showing a high-pressure pump according to an embodiment of the invention.

As shown in FIG. 1, a high-pressure pump 1 is comprised of a main body 10, a fuel supply portion 30, a suction valve portion 50, a plunger portion 70, and a discharge valve portion 90.

The main body 10 includes a housing 11 which forms an outer profile of the high-pressure pump 1. The fuel supply portion 30 is formed on the housing 11. The plunger portion 70 is formed at an opposite side of the fuel supply portion 30. A compression chamber 12 is defined in the housing 11 between the plunger portion 70 and the fuel supply portion 30. The suction valve portion 50 and the discharge valve portion 90 are formed at left side and right side of the main body 10 respectively.

Then, the configurations of the fuel supply portion 30, the suction valve portion 50, the plunger portion 70, and the discharge valve portion 90 will be described in detail, hereinafter.

The fuel supply portion 30 includes a fuel gallery 31. The fuel gallery 31 is a space defined by a concave portion 13 of the housing 11 and a lid member 14. A damper unit 32 is provided in the fuel gallery 31. The damper unit 32 is comprised of a damper member 35, a bottom-side supporting member 36 disposed on a bottom 15 of the concave portion 13, and a lid-side supporting member 37 disposed under the lid member 14. The damper member 35 is comprised of two metallic diaphragms 33, 34.

Figure 2:
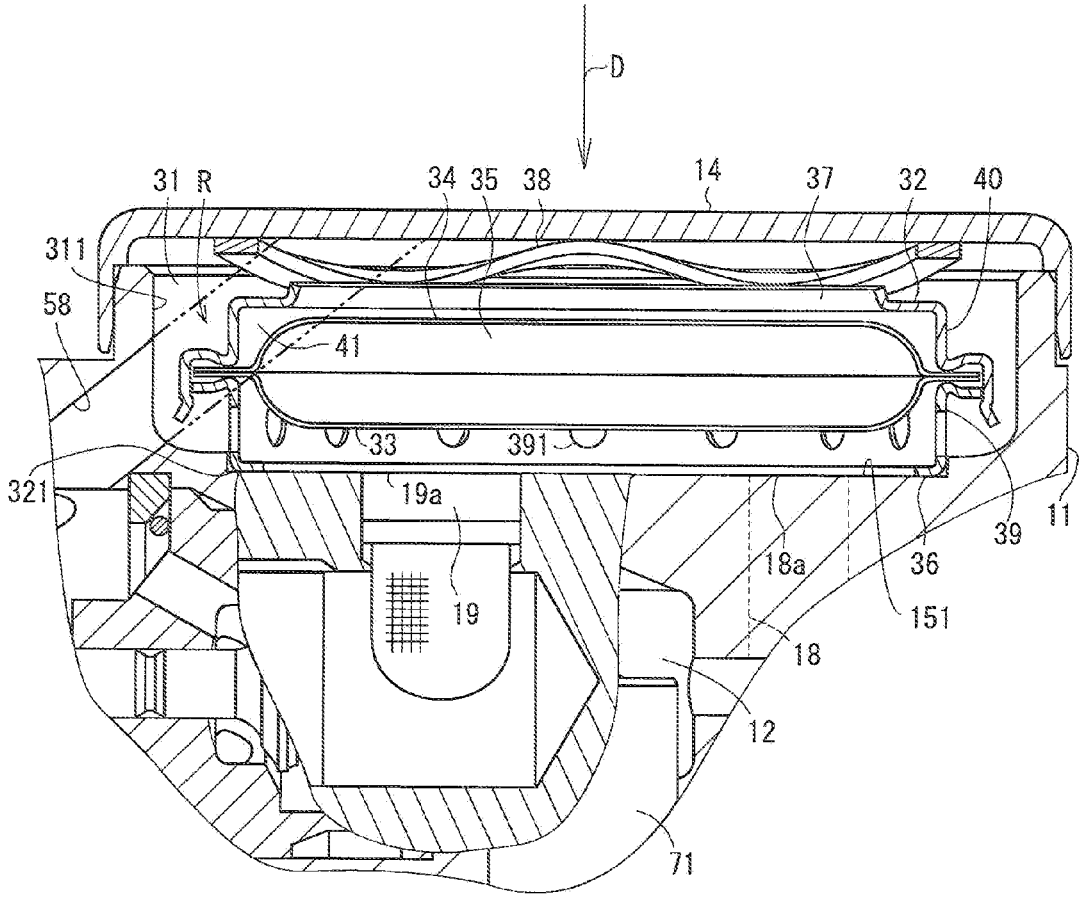
FIG. 2 is a fragmentally enlarged sectional view showing an essential part of a high-pressure pump according to the embodiment.

The fuel gallery 31 has a hollow 151 which receives the bottom-side supporting member 36, whereby the bottom-side supporting member 36 is positioned. As shown in FIG. 2, an opening 19*a* of a fuel inlet 19 is formed at the hollow 151. Thereby, the fuel supplied from the low-pressure pump is introduced into the fuel gallery 31 radially inside of the bottom-side supporting member 36.

A wavy disc spring 38 is disposed on the lid-side supporting member 37. In a condition where the lid member 14 is attached to the housing 11, the wavy disc spring 38 urges the lid-side supporting member 37 toward the bottom 15. This urging direction is denoted by an arrow "D" in FIG. 2. Consequently, an outer periphery of the damper member 35 is cramped by the lid-side supporting member 37 and the bottom-side supporting member 36, whereby the damper member 35 is supported in the fuel gallery 31.

Then, the plunger portion 70 will be described. As shown in FIG. 1, the plunger portion 70 includes a plunger 71, an oil-seal holder 72, a spring seat 73 and a plunger-spring 74.

The plunger 71 has a large diameter portion 711 and a small diameter portion 712. The large diameter portion 711 is slidabily supported in a cylinder 16 which is formed in the housing 11. The small diameter portion 712 is surrounded by an oil seal holder 72. An outer diameter of the small diameter portion 712 is smaller than that of the large diameter portion 711. The large diameter portion 711 and the small diameter portion 712 axially reciprocate.

The oil-seal holder 72 is arranged at an opening end of the cylinder 16 and has a base portion 721 surrounding the small diameter portion 712 of the plunger 71 and a press-insert portion 722 which is press-inserted into the housing 11.

The base portion 721 has a ring-shaped seal 723 therein. The ring-shaped seal 723 is comprised of an inner seal member and an outer O-ring. A thickness of the fuel on the small diameter portion 712 is adjusted by the ring-shaped seal 723 to restrict a leakage of the fuel.

The base portion 721 has an oil-seal 725 on its tip end. A thickness of the oil on the small diameter portion 712 is adjusted by the oil-seal 725 to restrict a leakage of the fuel.

The press-insert portion 722 cylindrically extends from the base portion 721. Meanwhile, the housing 11 has a concave portion 17 receiving the press-insert portion 722. Thereby, the oil-seal holder 72 is press-inserted into the housing 11 in such a manner that the press-insert portion 722 is press-fitted to an outer wall of the concave portion 17.

A spring seat 73 is provided at a tip end of the plunger 71. The tip end of the plunger 71 is in contact with a tappet (not shown). The tappet is in contact with a cam (not shown) of a camshaft and reciprocates according to a cam profile of the cam. Thereby, the plunger 71 reciprocates in its axial direction.

One end of the plunger spring 74 is engaged with the spring seat 73 and the other end of the plunger spring 74 is engaged with the press-insert portion 722. The plunger spring 74 biases the plunger 71 downWardly so that the plunger 71 is in contact with the tappet.

The plunger 71 reciprocates along with a cam profile of a camshaft. According to a reciprocation of the large diameter portion 711 of the plunger 71, a volume of the compression chamber 12 is varied.

Moreover, a variable volume chamber 75 is defined around the small diameter portion 712 of the plunger 71. In the present embodiment, the variable volume chamber 75 is defined by the cylinder 16, a bottom end of the large diameter portion 711 of the plunger 71, an outer surface of the small diameter portion 712, and the seal 723 of the oil-seal holder 72. The seal 723 hermetically seals the variable volume chamber 75 to avoid a fuel leakage therefrom.

The variable volume chamber 75 is fluidly connected to the fuel gallery 31 through a cylindrical passage 727 formed between the press-insert portion 722 and the concave portion 17, an annular passage 728 formed at a bottom of the concave portion 17, and a volume-chamber passage 18 formed in the housing 11 which is illustrated by dashed lines in FIG. 1. As shown in FIG. 2, an opening 18*a* of the volume-chamber passage 18 is formed at the bottom 15 (hollow 151) of the fuel gallery 31.

Next, the suction valve portion 50 will be described in detail. As shown in FIG. 1, the suction valve portion 50 includes a cylindrical portion 51 of the housing 11, a valve cover 52 which covers an opening of the cylindrical portion 51, and a connector 53. The cylindrical portion 51 defines a fuel passage 55 therein. A cylindrical seat body 56 is provided in the fuel passage 55. The seat body 56 includes a suction valve 57 therein. Further, the fuel passage 55 communicates with the fuel gallery 31 through a press-side passage 58.

A needle 59 is in contact with the suction valve 57. This needle 59 penetrates the valve cover 52 and extends to an interior of the connector 53. The connector 53 has a coil 531 and a terminal 532 for energizing the coil 531. A fixed core 533, a movable core 534, and a spring 535 are disposed inside of the coil 531. The needle 59 is mechanically connected to the movable core 534. That is, the movable core 534 and the needle 59 slide together.

When the coil 531 is energized through the terminal 532, a magnetic attraction force is generated between the fixed core 533 and the movable core 534. The movable core 534 is attracted to the fixed core 533 with the needle 59. At this time, a movement of the suction valve 57 is not restricted by the needle 59. Thus, the suction valve 57 seats on the seat body 56 to disconnect the fuel passage 55 and the compression chamber 12.

Meanwhile, when the coil 531 is deenergized, the movable core 534 moves apart from. the fixed core 533 by a. biasing force of the spring 535. Thereby, the needle 59 comes close to the compression chamber 12. The movement of the suction valve 57 is restricted by the needle 59. The suction valve 57 is unseated from the seat body 56 so that the fuel passage 55 communicates with the compression chamber 12.

Then, the discharge valve portion 90 will be described in detail, hereinafter. The discharge valve portion 90 has a cylindrical accommodation portion 91 of the housing 11, as shown in FIG. 1. The accommodation portion 91 defines an accommodation chamber 911 in which a discharge valve 92, a spring 93 and an engaging member 94 are provided. An opening portion of the accommodation chamber 911 corresponds to a discharge port 95. A valve seat is formed in the accommodation chamber 911.

The discharge valve 92 is biased to the valve seat by the spring 93 and a fuel pressure from a fuel rail (not shown). While the fuel pressure in the compression chamber 12 is relatively low, the discharge valve 92 seats on the valve seat so that no fuel is discharged from the discharge port 95. Meanwhile, when the fuel pressure in the compression chamber 12 exceeds the biasing force of the spring 93 and the fuel pressure from the fuel rail, the discharge valve 92 is unseated from the valve seat, so that the fuel in the compression chamber 12 is discharged from the discharge port 95.

According to the present embodiment, as shown in FIG. 2, the press-side passage 58 is formed in such a manner that a supposed extended passage, which is illustrated by double-dashed line "R", extends to the lid member 14.

Specifically, as shown in FIG. 2, the press-side passage 58 is opened at a side wall 311 of the fuel gallery 31. The press-side passage 58 is formed in such a manner that its center axis is inclined relative to a direction denoted by the arrow "D". Further, the press-side passage 58 and the damper unit 32 are arranged in such a manner that a bottom-side fringe 321 of the damper unit 32 is not positioned in the supposed extended passage "R".

The bottom-side supporting member 36 has a bottom-side cylindrical wall 39 which surrounds the diaphragm 33. The bottom-side cylindrical wall 39 has a plurality of holes 391 arranged circumferentially at regular intervals. The lid-side supporting member 37 has a lid-side cylindrical wall 40 which surrounds the diaphragm 34. The lid-side cylindrical wall 40 defines a partial gallery space 41 therein.

An operation of the high-pressure pump 1 will be described hereinafter. The high-pressure pump 1 repeatedly performs the suction stroke, the metering stroke, and the compression stroke. In the suction stroke, the fuel is suctioned from the fuel gallery 31 to the compression chamber 12. The plunger 71 slides down from the top dead center to the bottom center and the suction valve 57 is opened.

In the metering stroke, the fuel is returned from the compression chamber 12 to the fuel gallery 31: The plunger 71 slides up toward the top dead center and the suction valve 57 is opened. In the metering stroke, the fuel is returned from the compression chamber 12 to the fuel gallery 31. This returned fuel is low-pressure fuel. This metering method is called a pre-stroke metering.

In the compression stroke, the fuel is discharged from the compression chamber 12 through the discharge valve portion 90. The plunger 71 slides up toward the top dead center and the suction valve 57 is closed.

A function of the variable volume chamber 75 will be described hereinafter. In the suction stroke, the plunger 71 slides down to increase the volume of the compression chamber 12. Meanwhile, a volume of the variable volume chamber 75 is decreased. Thus, the fuel stored in the variable volume chamber 75 is supplied to the fuel gallery 31.

In the metering stroke, the plunger 71 slides up to reduce the volume of the compression chamber 12. The volume of the variable volume chamber 75 is increased. Therefore, a part of low-pressure fuel which is returned to the fuel gallery 31 from the compression chamber 12 is introduced into the variable volume chamber 75.

The variations in the volume of the variable volume chamber 75 and the compression chamber 12 are caused by a movement of the large diameter portion 711 of the plunger 71. During the compression stroke, the suction valve 57 is closed so that no fuel is returned to the fuel gallery 31 from the compression chamber 12.

An advantage which the high-pressure pump 1 achieves will be described hereinafter. First, an advantage of the variable volume chamber 75 will be described. Then, an advantage of the fuel supply portion 30 will be described. The compression chamber 12 and the variable volume chamber 75 simultaneously vary in the volume thereof. The following description is based on an assumption that the volume change in the compression chamber 12 is represented by "100" and the volume change in the variable volume chamber 75 is represented by "60".

In the metering stroke, it is required to restrict a fuel pulsation. In a case that a decreased volume of the compression chamber 12 is "100", a fuel pressure pulsation corresponding to "100" is generated in the fuel gallery 31. This fuel pressure pulsation is transmitted to a fuel pipe and a fuel pipe supporting member, which may cause noise problems. If a resonance arises in the fuel pipe supporting member, the fuel pipe supporting member may be damaged.

According to the present embodiment, the volume of the variable volume chamber 75 is increased as the volume of the compression chamber 12 is decreased. The ratio between volumes of these chambers is 100:60. Thus, in a case that the decreased volume of the compression chamber 12 is represented by "100", the increased volume of the variable volume chamber 75 is represented by "60". That is, "60" amount of the fuel discharged from the compression chamber 12 is introduced into the variable volume chamber 75. Thus, the fuel pressure pulsation generated in the fuel gallery 31 corresponds to "40" of the fuel.

Since the volume variation of the compression chamber 12 and the volume variation of the variable volume chamber 75 are generated at the same time, the above described advantage is always obtained without respect to the engine speed.

Furthermore, since the seal 723 and the oil seal 725 are provided around the small diameter portion 312, the sealing length becomes shorter than the case where the seals are provided around the large diameter portion 311. Further, since the oil-seal holder 72 can be made small, the plunger spring 74 is also made small.

By increasing the diameter of the large diameter portion 711, the discharge quantity can be increased.

Then, an advantage of the fuel supply portion 30 will be described. The supposed extended passage "R" of the press-side passage 58 extends toward the lid member 14. Specifically, the press-side passage 58 is opened at the side wall 311 of the fuel gallery 31. The press-side passage 58 is formed in such a manner that its center axis is inclined relative to the direction denoted by the arrow "D".

Thereby, a large part of fuel having high flow velocity is introduced toward the lid member 14 of the damper unit 32. In other words, the mainstream of fuel when the flow velocity becomes high is led to the lid member 14 of the damper unit 32. The fuel, flows through the lid member 14, so that the fuel hardly flows into the fuel inlet 19 directly. Consequently, even when the flow velocity of the fuel returned to the fuel gallery 31 is increased, the fuel pressure pulsation can be well restricted.

Further, the high-pressure pump 1 is configured in such a manner that the bottom-side fringe 321 of the damper unit 32 does not exist in the supposed extended passage "R". Thereby, it is restricted that the fuel flows into the fuel inlet 19 directly.

According to the present embodiment, the damper unit 32 can be structured by simple configuration.

The lid-side supporting member 37 has the lid-side cylindrical wall 40 which defines the partial gallery space 41 therein. As a result, it is likely that the fuel remains in the partial gallery space 41 for a relatively long time period, so that it is restricted that the fuel flows into the fuel inlet 19 directly.

The present invention is not limited to the embodiments mentioned above, and can be applied to various embodiments. In the above embodiment, the press-side passage 58 is inclined relative to the direction "D". The press-side passage 58 can be formed in L-shape to have its opening at a vicinity of the lid member 14. Alternatively, the press-side passage 58 can be formed to have its opening at the bottom 15 between the bottom-side cylindrical wall 39 and the side wall 311 of the fuel gallery 31.

What is claimed is:

1. A high-pressure pump comprising:

a press-side passage fluidly connecting a fuel gallery which has a fuel inlet at a bottom thereof and a compression chamber in which fuel is compressed;

a plunger for varying a volume of the compression chamber and defining a variable volume chamber of which a volume thereof is varied along with a variation in the volume of the compression chamber;

a volume-chamber passage fluidly connecting the variable volume chamber and the fuel gallery;

a damper unit provided in the fuel gallery for restricting a variation in a fuel pressure in the fuel gallery; and a lid member for closing the fuel gallery while biasing the damper unit through an elastic member; wherein the press-side passage is configured in such a manner that a main stream of a fuel flow, which is returned from the compression chamber to the fuel gallery by the plunger, flows toward the lid member which is opposed to the fuel inlet, the press-side passage is configured such that a supposed extended passage thereof extends to the lid member in the fuel gallery, and a bottom-side fringe of the damper unit is positioned outside of the supposed extended passage of the press-side passage.

2. The high-pressure pump according to claim 1, wherein the press-side passage is opened at a side wall of the fuel gallery, and the press-side passage is configured such that a center axis thereof is inclined relative to a biasing direction of the lid member.

3. The high-pressure pump according to claim 1, wherein the damper unit includes:

a damper member having two diaphragms;

a bottom-side supporting member arranged on the bottom of the fuel gallery; and a lid-side supporting member supporting a peripheral portion of the damper member in cooperation with the bottom-side supporting member.

4. The high-pressure pump according to claim 3, wherein the lid-side supporting member has a cylindrical wall which surrounds one of the diaphragms to define a partial gallery space therebetween.

5. The high-pressure pump according to claim 4, wherein the partial gallery space is opened toward the lid member.

* * * * *